US007664633B2

(12) United States Patent
Den Brinker et al.

(10) Patent No.: US 7,664,633 B2
(45) Date of Patent: Feb. 16, 2010

(54) AUDIO CODING VIA CREATION OF SINUSOIDAL TRACKS AND PHASE DETERMINATION

(75) Inventors: Albertus Cornelis Den Brinker, Eindhoven (NL); Andreas Johannes Gerrits, Eindhoven (NL); Robert Johannes Sluijter, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 531 days.

(21) Appl. No.: 10/536,228

(22) PCT Filed: Nov. 6, 2003

(86) PCT No.: PCT/IB03/05019

§ 371 (c)(1),
(2), (4) Date: May 24, 2005

(87) PCT Pub. No.: WO2004/051627

PCT Pub. Date: Jun. 17, 2004

(65) Prior Publication Data

US 2006/0036431 A1 Feb. 16, 2006

(30) Foreign Application Priority Data

Nov. 29, 2002 (EP) ..... 02080002

(51) Int. Cl.

| | |
|---|---|
| ***G10L 11/04*** | (2006.01) |
| ***G10L 11/00*** | (2006.01) |
| ***G10L 19/00*** | (2006.01) |
| ***G10L 19/12*** | (2006.01) |

(52) U.S. Cl. ..... 704/206; 704/200; 704/200.1; 704/205; 704/222; 704/230

(58) Field of Classification Search ..... 704/200–207, 704/222, 230

See application file for complete search history.

(56) References Cited

U.S. PATENT DOCUMENTS

| | | | | |
|---|---|---|---|---|
| 4,151,471 | A * | 4/1979 | Packard et al. | 455/224 |
| 4,937,873 | A * | 6/1990 | McAulay et al. | 704/265 |
| 5,119,397 | A * | 6/1992 | Dahlin et al. | 375/216 |
| 5,602,959 | A * | 2/1997 | Bergstrom et al. | 704/205 |

(Continued)

FOREIGN PATENT DOCUMENTS

WO WO 0169593 A1 9/2001

OTHER PUBLICATIONS

S. Ahmadi et al: "Minimum-Variance Phase Prediction and Frame Interpolation Algorithms for Low Bit Rate Sinusoidal Speech Coding", ISCAS 2000 IEEE International Symposium on.

(Continued)

*Primary Examiner*—Richemond Dorvil
*Assistant Examiner*—Eric Yen

(57) ABSTRACT

Coding of an audio signal represented by a respective set of sampled signal values for each of a plurality of sequential segments is disclosed. The sampled signal values are analyzed (40) to determine one or more sinusoidal components for each of the plurality of sequential segments. The sinusoidal components are linked (42) across a plurality of sequential segments to provide sinusoidal tracks. For each sinusoidal track, a phase comprising a generally monotonically changing value is determined and an encoded audio stream including sinusoidal codes (r) representing said phase is generated (46).

16 Claims, 4 Drawing Sheets

U.S. PATENT DOCUMENTS

| | | | | |
|---|---|---|---|---|
| 5,646,961 | A * | 7/1997 | Shoham et al. | 375/243 |
| 5,710,863 | A * | 1/1998 | Chen | 704/200.1 |
| 5,727,119 | A * | 3/1998 | Davidson et al. | 704/203 |
| 5,765,126 | A * | 6/1998 | Tsutsui et al. | 704/200.1 |
| 5,893,057 | A * | 4/1999 | Fujimoto et al. | 704/246 |
| 6,118,879 | A * | 9/2000 | Hanna | 381/106 |
| 6,219,637 | B1 * | 4/2001 | Choi et al. | 704/223 |
| 6,496,797 | B1 * | 12/2002 | Redkov et al. | 704/220 |
| 7,039,581 | B1 * | 5/2006 | Stachurski et al. | 704/205 |
| 7,184,951 | B2 * | 2/2007 | Royle et al. | 704/205 |
| 7,295,752 | B1 * | 11/2007 | Jain et al. | 386/46 |
| 7,349,841 | B2 * | 3/2008 | Furuta et al. | 704/226 |
| 7,596,490 | B2 * | 9/2009 | Hotho et al. | 704/219 |
| 2005/0228650 | A1 * | 10/2005 | Huang | 704/205 |

OTHER PUBLICATIONS

A.C. Den Brinker et al; Phase Transmission in a Sinusoidal Audio and Speech Coder. 115th AES Convention, Audio Engineering Society, Oct. 10-13, 2003, XP009028272.

H. Purnhagen; "Advances in Parametric Audio Coding" Applications of Signal Processing to Audio and Acoustics, 1999 IEEE Workshop on New Paltz, NY, Oct. 17-20, 1999, Piscataway.

* cited by examiner

AUDIO CODING VIA CREATION OF SINUSOIDAL TRACKS AND PHASE DETERMINATION

FIELD OF THE INVENTION

The present invention relates to coding and decoding audio signals.

BACKGROUND OF THE INVENTION

Referring now to FIG. 1, a parametric coding scheme in particular a sinusoidal coder is described in PCT Patent Application No. WO01/69593. In this coder, an input audio signal x(t) is split into several (overlapping) segments or frames, typically of length 20 ms. Each segment is decomposed into transient, sinusoidal and noise components. (It is also possible to derive other components of the input audio signal such as harmonic complexes although these are not relevant for the purposes of the present invention.)

In the sinusoidal analyser 130, the signal x2 for each segment is modelled using a number of sinusoids represented by amplitude, frequency and phase parameters. This information is usually extracted for an analysis interval by performing a Fourier Transform (FT) which provides a spectral representation of the interval including: frequencies; amplitudes for each frequency; and phases for each frequency where each phase is in the range $\{-\pi,\pi\}$. Once the sinusoidal information for a segment is estimated, a tracking algorithm is initiated. This algorithm uses a cost function to link sinusoids with each other on a segment-to-segment basis to obtain so-called tracks. The tracking algorithm thus results in sinusoidal codes $C_S$ comprising sinusoidal tracks that start at a specific time instance, evolve for a certain amount of time over a plurality of time segments and then stop.

In such sinusoidal coding, frequency information is usually transmitted for the tracks formed in the encoder. This can be done cheaply, since tracks are defined as having a slowly varying frequency and, therefore, frequency can be transmitted efficiently by time-differential encoding. (In general, amplitude can also be encoded differentially over time.)

In contrast to frequency, phase transmission is viewed as expensive. In principle, if the frequency is (nearly) constant, phase as a function of the track segment index should adhere to a (nearly) linear behaviour. However, when it is transmitted, phase is limited to the range $\{-\pi,\pi\}$ as provided by the Fourier Transform. Because of this modulo $2\pi$ representation of phase, the structural inter-frame relation of the phase is lost and, at first sight appears to be a white stochastic variable.

However, since the phase is the integral of the frequency, the phase need, in principle, not be transmitted. This is called phase continuation and reduces the bit rate significantly.

In phase continuation, only the frequency is transmitted and the phase is recovered at the decoder from the frequency data by exploiting the integral relation between phase and frequency. It is known, however, that the phase can only be approximately recovered using phase continuation. If frequency errors occur, due to measurement errors in the frequency or due to quantisation noise, the phase, being reconstructed using the integral relation, will typically show an error having the character of a drift. This is because frequency errors have an approximately white noise character. Integration amplifies low-frequency errors and, consequently, the recovered phase will tend to drift away from the actually measured phase. This leads to audible artifacts.

This is illustrated in FIG. 2(*a*) where $\psi$ and $\Omega$ are the real frequency and phase for a track. In both the encoder and decoder frequency and phase have an integral relationship represented by I. The quantisation process in the encoder is modelled as an additive white noise n. In the decoder, the recovered phase $\hat{\psi}$ thus includes two components: the real phase $\psi$ and a noise component $\epsilon_2$, where both the spectrum of the recovered phase and the power spectral density function of the noise $\epsilon_2$ have a pronounced low-frequency character.

Thus, it can be seen that in phase continuation, since the recovered phase is the integral of a low-frequency signal, the recovered phase is a low-frequency signal itself. However, the noise introduced in the reconstruction process is also dominant in this low-frequency range. It is therefore difficult to separate these sources with a view to filtering the noise n introduced during encoding.

The present invention attempts to mitigate this problem.

DISCLOSURE OF THE INVENTION

According to the present invention there is provided a method according to claim 1.

According to the invention the prior art sinusoidal coding technique is reversed i.e. phase rather than frequency is transmitted. In the decoder, the frequency can be approximately recovered from the quantised phase information using finite differences as an approximation for differentiation. The noise component of the recovered frequency has a pronounced high-frequency behaviour under the assumption that the noise introduced by the phase quantisation is nearly spectrally flat. This is illustrated in FIG. 2(*b*), where within the encoder and the decoder, frequency is represented as the differential (D) of phase. Again, noise n is introduced in the encoder and so in the decoder, the recovered frequency $\hat{\Omega}$ includes two components: the real frequency $\Omega$ and a noise component $\epsilon_4$, where the frequency is nearly a DC signal and the noise is mainly in high-frequency range. However, since the underlying frequency has a low-frequency behaviour and the added noise a high-frequency behaviour, the noise component $\epsilon_4$ of the recovered frequency can be reduced by low-pass filtering.

DESCRIPTION OF THE PREFERRED EMBODIMENT

Figure 1:
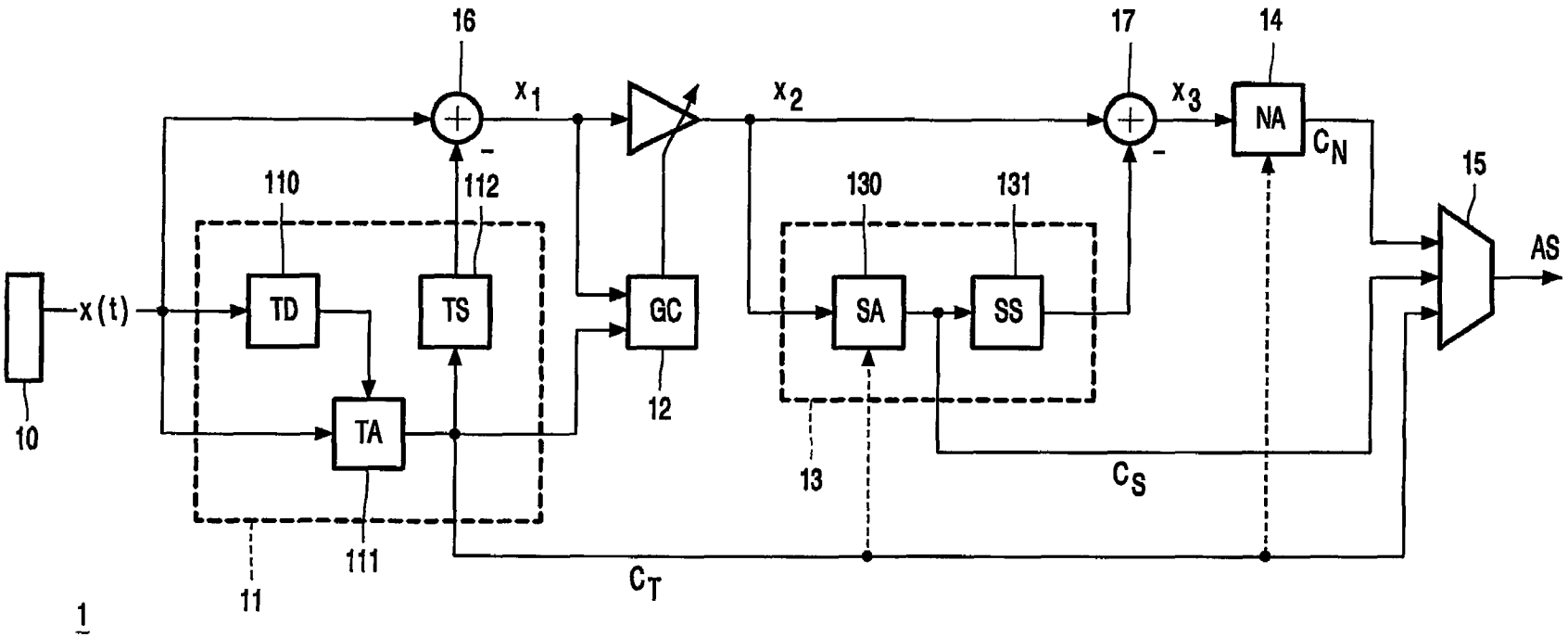
FIG. 1 shows an audio coder in which an embodiment of the invention is implemented.

Preferred embodiments of the invention will now be described with reference to the accompanying drawings wherein like components have been accorded like reference numerals and, unless otherwise stated perform a like function. In a preferred embodiment of the present invention, the encoder 1 is a sinusoidal coder of the type described in PCT Patent Application No. WO 01/69593, FIG. 1. The operation of this prior art coder and its corresponding decoder has been well described and description is only provided here where relevant to the present invention.

In both the prior art and the preferred embodiment, the audio coder 1 samples an input audio signal at a certain sampling frequency resulting in a digital representation x(t) of the audio signal. The coder 1 then separates the sampled input signal into three components: transient signal components, sustained deterministic components, and sustained stochastic components. The audio coder 1 comprises a transient coder 11, a sinusoidal coder 13 and a noise coder 14.

The transient coder 11 comprises a transient detector (TD) 110, a transient analyzer (TA) 111 and a transient synthesizer (TS) 112. First, the signal x(t) enters the transient detector 110. This detector 110 estimates if there is a transient signal component and its position. This information is fed to the transient analyzer 111. If the position of a transient signal component is determined, the transient analyzer 111 tries to extract (the main part of) the transient signal component. It matches a shape function to a signal segment preferably starting at an estimated start position, and determines content underneath the shape function, by employing for example a (small) number of sinusoidal components. This information is contained in the transient code $C_T$ and more detailed information on generating the transient code $C_T$ is provided in PCT Patent Application No. WO 01/69593.

The transient code $C_T$ is furnished to the transient synthesizer 112. The synthesized transient signal component is subtracted from the input signal x(t) in subtractor 16, resulting in a signal x1. A gain control mechanism GC (12) is used to produce x2 from x1.

The signal x2 is furnished to the sinusoidal coder 13 where it is analyzed in a sinusoidal analyzer (SA) 130, which determines the (deterministic) sinusoidal components. It will therefore be seen that while the presence of the transient analyser is desirable, it is not necessary and the invention can be implemented without such an analyser. Alternatively, as mentioned above, the invention can also be implemented with for example an harmonic complex analyser.

Figure 3A:
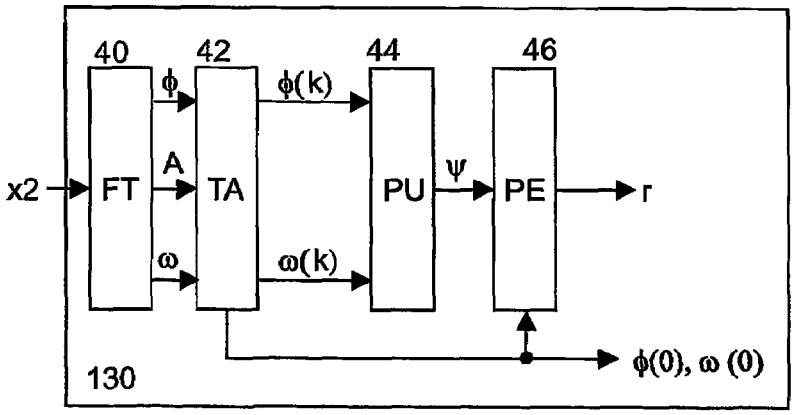
FIGS. 3(*a*) and 3(*b*) show a preferred embodiment of a sinusoidal coder component of the audio coder of FIG. 1.
Figure 3B:
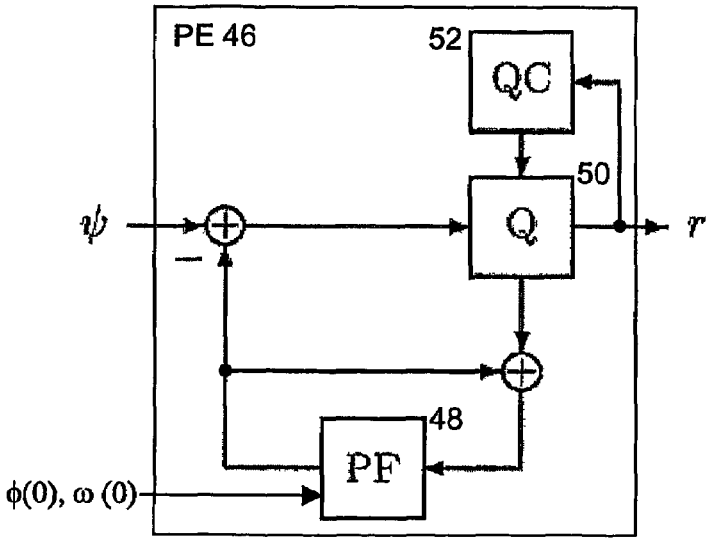

In brief, the sinusoidal coder encodes the input signal x2 as tracks of sinusoidal components linked from one frame segment to the next. Referring now to FIG. 3(*a*), in the same manner as in the prior art, in the preferred embodiment, each segment of the input signal x2 is transformed into the frequency domain in a Fourier Transform (FT) unit 40. For each segment, the FT unit provides measured amplitudes A, phases $\phi$ and frequencies $\omega$. As mentioned previously, the range of phases provided by the Fourier Transform is restricted to $-\pi \leqq \phi < \pi$. A tracking algorithm (TA) unit 42 takes the information for each segment and by employing a suitable cost function, links sinusoids from one segment to the next, so producing a sequence of measured phases $\phi(k)$ and frequencies $\omega(k)$ for each track.

In contrast to the prior art, according to the present invention the sinusoidal codes $C_S$ ultimately produced by the analyzer 130 include phase information, and frequency is reconstructed from this information in the decoder.

As mentioned above, however, the measured phase is restricted to a modulo $2\pi$ representation. Therefore, in the preferred embodiment, the analyzer comprises a phase unwrapper (PU) 44 where the modulo $2\pi$ phase representation is unwrapped to expose the structural inter-frame phase behaviour for a track $\psi$. As the frequency in sinusoidal tracks is nearly constant, it will be seen that the unwrapped phase $\psi$ will typically be a linearly increasing (or decreasing) function and this makes cheap transmission of phase possible. The unwrapped phase $\psi$ is provided as input to a phase encoder (PE) 46 which provides as output representation levels r suitable for being transmitted.

Referring now to the operation of the phase unwrapper 44, as mentioned above, actual phase $\psi$ and actual frequency $\Omega$ for a track are related by:

$$\psi(t) = \int_{T_0}^{t} \Omega(\tau)d\tau + \psi(T_0) \qquad \text{Equation 1}$$

with $T_0$ a reference time instant.

A sinusoidal track in frames k=K, K+1 . . . K+L−1 has measured frequencies $\omega(k)$ (expressed in radians per second) and measured phases $\phi(k)$ (expressed in radians). The distance between the centre of the frames is given by U (update rate expressed in seconds). The measured frequencies are supposed to be samples of the assumed underlying continuous-time frequency track $\Omega$ with $\omega(k)=\Omega(kU)$ and, similarly, the measured phases are samples of the associated continuous-time phase track $\psi$ with $\phi(k)=\psi(kU) \bmod (2\pi)$. For sinusoidal coding it is assumed that $\Omega$ is a nearly constant function.

Assuming that the frequencies are nearly constant within a segment Equation 1 can be approximated as follows:

$$\begin{aligned}\psi(kU) &= \int_{(k-1)U}^{kU} \Omega(t)dt + \psi((k-1)U) \\ &\approx \{\omega(k)+\omega(k-1)\}U/2 + \psi((k-1)U).\end{aligned} \qquad \text{Equation 2}$$

It will therefore be seen that knowing the phase and frequency for a given segment and the frequency of the next segment, it is possible to estimate an unwrapped phase value for the next segment, and so on for each segment in a track.

In the preferred embodiment, the phase unwrapper determines an unwrap factor m(k) at instant k:

$$\psi(kU)=\phi(k)+m(k)2\pi \qquad \text{Equation 3}$$

The unwrap factor m(k) tells the phase unwrapper 44 the number of cycles which has to be added to obtain the unwrapped phase.

Combining equations 2 and 3, the phase unwrapper determines an incremental unwrap factor e as follows:

$$2\pi e(k)=2\pi\{m(k)-m(k-1)\}=\{\omega(k)+\omega(k-1)\}U/2-\{\phi(k)-\phi(k-1)\}$$

where e should be an integer. However, due to measurement and model errors, the incremental unwrap factor will not be an integer exactly, so:

$$e(k)=\mathrm{round}([\{\omega(k)+\omega(k-1)\}U/2-\{\phi(k)-\phi(k-1)\}]/(2\pi))$$

assuming that the model and measurement errors are small.

Having the incremental unwrap factor e, the m(k) from equation (3) is calculated as the cumulative sum where, without loss of generality, the phase unwrapper starts in the first frame K with m(K)=0, and from m(k) and $\phi(k)$, the (unwrapped) phase $\psi(kU)$ is determined.

In practice, the sampled data $\psi(kU)$ and $\Omega(kU)$ are distorted by measurement errors:

$$\phi(k)=\psi(kU)+\epsilon_1(k),$$

$$\omega(k)=\Omega(kU)+\epsilon_2(k),$$

where $\epsilon_1$ and $\epsilon_2$ are the phase and frequency errors, respectively. In order to prevent the determination of the unwrap factor becoming ambiguous, the measurement data needs to be determined with sufficient accuracy. Thus, in the preferred embodiment, tracking is restricted so that:

$$\delta(k)=e(k)-[\{\omega(k)+\omega(k-1)\}U/2-\{\phi(k)-\phi(k-1)\}]/(2\pi)<\delta_0$$

where $\delta$ is the error in the rounding operation. The error $\delta$ is mainly determined by the errors in $\omega$ due to the multiplication with U. Assume that $\omega$ is determined from the maxima of the absolute value of the Fourier Transform from a sampled version of the input signal with sampling frequency $F_s$ and that the resolution of the Fourier Transform is $2\pi/L_a$ with $L_a$ the analysis size. In order to be within the considered bound, we have:

$$\frac{L_a}{U}=\delta_0$$

That means that the analysis size should be few times larger than the update size in order for unwrapping to be accurate, e.g., setting $\delta_0=1/4$, the analysis size should be four times the update size (neglecting the errors $\epsilon_1$ in the phase measurement).

The second precaution which can be taken to avoid decision errors in the round operation is to defining tracks appropriately. In the tracking unit 42, sinusoidal tracks are typically defined by considering amplitude and frequency differences. Additionally, it is also possible to account for phase information in the linking criterion. For instance, we can define the phase prediction error $\epsilon$ as the difference between the measured value and the predicted value $\tilde{\phi}$ according to $$\epsilon=\{\phi(k)-\tilde{\phi}(k)\} \bmod 2\pi$$

where the predicted value can be taken as $$\tilde{\phi}(k)=\phi(k-1)+\{\omega(k)-\omega(k-1)\}U/2$$

Thus, preferably the tracking unit 42 forbids tracks where $\epsilon$ is larger than a certain value (e.g. $\epsilon>\pi/2$), resulting in an unambiguous definition of e(k).

Additionally, the encoder may calculate the phases and frequencies such as will be available in the decoder. If the phases or frequencies which will become available in the decoder differ too much from the phases and/or frequencies such as are present in the encoder, it may be decided to interrupt a track, i.e. to signal the end of a track and start a new one using the current frequency and phase and their linked sinusoidal data.

The sampled unwrapped phase $\psi(kU)$ produced by the phase unwrapper (PU) 44 is provided as input to phase encoder (PE) 46 to produce the set of representation levels r. Techniques for efficient transmission of a generally monotonically changing characteristic such as the unwrapped phase are known. In the preferred embodiment, FIG. 3(*b*), Adaptive Differential Pulse Code Modulation (ADPCM) is employed. Here, a predictor (PF) 48 is used to estimate the phase of the next track segment and encode the difference only in a quantizer (Q) 50. Since $\psi$ is expected to be a nearly linear function and for reasons of simplicity, the predictor 48 is chosen as a second-order filter of the form:

$$y(k+1)=2x(k)-x(k-1)$$

where x is the input and y is the output. It will be seen, however, that it is also possible to take other functional relations (including higher-order relations) and to include adaptive (backward or forward) adaptation of the filter coefficients. In the preferred embodiment, a backward adaptive control mechanism (QC) 52 is used for simplicity to control the quantiser 50. Forward adaptive control is also possible as well but would require extra bit rate overhead.

As will be seen, initialization of the encoder (and decoder) for a track starts with knowledge of the start phase $\phi(\mathbf{0})$ and frequency $\omega(\mathbf{0})$. These are quantized and transmitted by a separate mechanism. Additionally, the initial quantization step used in the quantization controller 52 of the encoder and the corresponding controller 62 in the decoder, FIG. 5(*b*), is either transmitted or set to a certain value in both encoder and decoder. Finally, the end of a track can either be signalled in a separate side stream or as a unique symbol in the bit stream of the phases.

From the sinusoidal code $C_S$ generated with the sinusoidal coder, the sinusoidal signal component is reconstructed by a sinusoidal synthesizer (SS) 131 in the same manner as will be described for the sinusoidal synthesizer (SS) 32 of the decoder. This signal is subtracted in subtractor 17 from the input x2 to the sinusoidal coder 13, resulting in a remaining signal x3. The residual signal x3 produced by the sinusoidal coder 13 is passed to the noise analyzer 14 of the preferred embodiment which produces a noise code $C_N$ representative of this noise, as described in, for example, PCT patent application No. PCT/EP00/04599.

Finally, in a multiplexer 15, an audio stream AS is constituted which includes the codes $C_T$, $C_S$ and $C_N$. The audio stream AS is furnished to e.g. a data bus, an antenna system, a storage medium etc.

Figure 4:
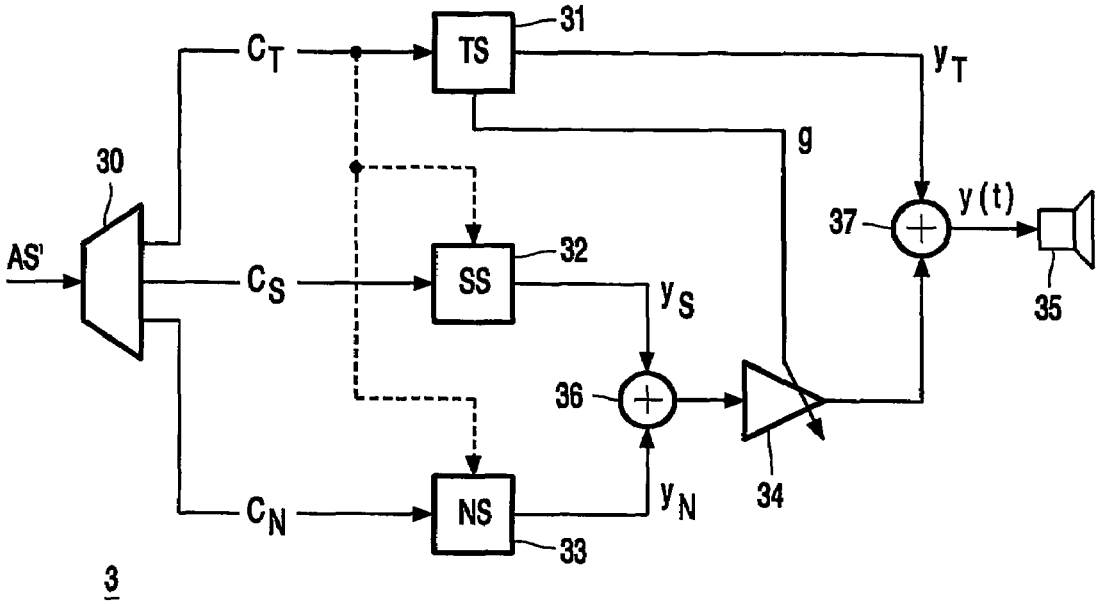
FIG. 4 shows an audio player in which an embodiment of the invention is implemented.

FIG. 4 shows an audio player 3 suitable for decoding an audio stream AS', e.g. generated by an encoder 1 of FIG. 1, obtained from a data bus, antenna system, storage medium etc. The audio stream AS' is de-multiplexed in a de-multiplexer 30 to obtain the codes $C_T$, $C_S$ and $C_N$. These codes are furnished to a transient synthesizer 31, a sinusoidal synthesizer 32 and a noise synthesizer 33 respectively. From the transient code $C_T$, the transient signal components are calculated in the transient synthesizer 31. In case the transient code indicates a shape function, the shape is calculated based on the received parameters. Further, the shape content is calculated based on the frequencies and amplitudes of the sinusoidal components. If the transient code $C_T$ indicates a step, then no transient is calculated. The total transient signal $y_T$ is a sum of all transients.

Figure 5A:
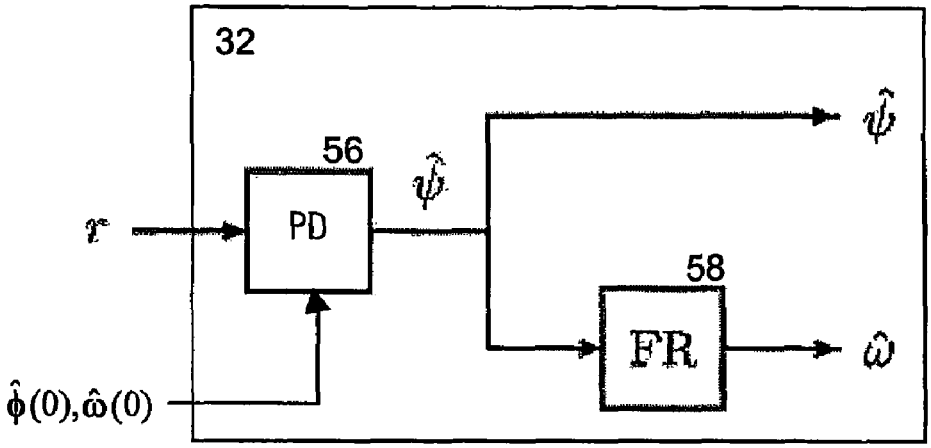
FIGS. 5(*a*) and 5(*b*) show a preferred embodiment of a sinusoidal synthesizer component of the audio player of FIG. 4.
Figure 5B:
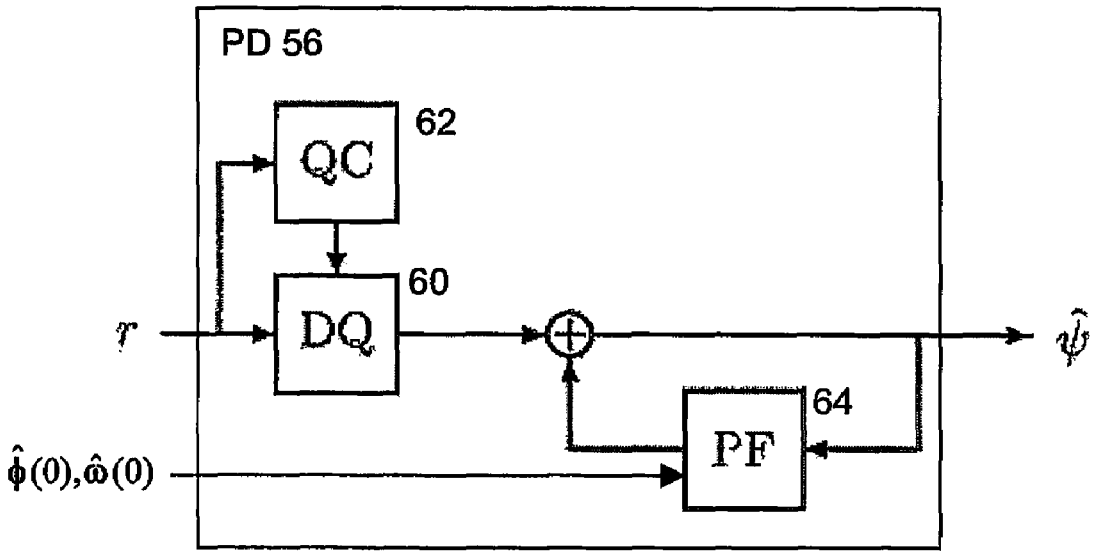

The sinusoidal code $C_S$ including the information encoded by the analyser 130 is used by the sinusoidal synthesizer 32 to generate signal $y_S$. Referring now to FIGS. 5(*a*) and (*b*), the sinusoidal synthesizer 32 comprises a phase decoder (PD) 56 compatible with the phase encoder 46. Here, a dequantiser (DQ) 60 in conjunction with a second-order prediction filter (PF) 64 produces (an estimate of) the unwrapped phase $\hat{\psi}$ from: the representation levels r; initial information $\hat{\phi}(\mathbf{0})$, $\hat{\omega}(\mathbf{0})$ provided to the prediction filter (PF) 64 and the initial quantization step for the quantization controller (QC) 62.

Figure 2A:
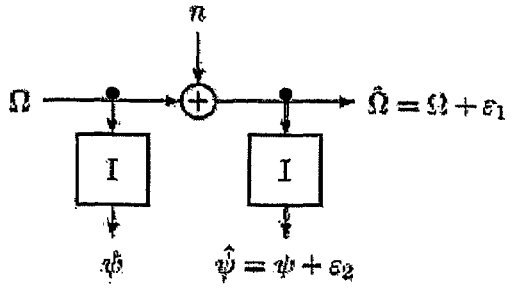
FIGS. 2(*a*) and 2(*b*) illustrate the relationship between phase and frequency in prior art systems and in audio systems according to the present invention respectively.
Figure 2B:
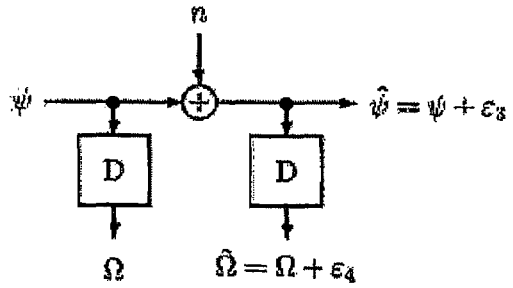

As illustrated in FIG. 2(*b*), the frequency can be recovered from the unwrapped phase $\hat{\psi}$ by differentiation. Assuming that the phase error at the decoder is approximately white and since differentiation amplifies the high frequencies, the differentiation can be combined with a low-pass filter to reduce the noise and, thus, to obtain an accurate estimate of the frequency at the decoder.

In the preferred embodiment, a filtering unit (FR) 58 approximates the differentiation which is necessary to obtain the frequency $\hat{\omega}$ from the unwrapped phase by procedures as forward, backward or central differences. This enables the decoder to produce as output the phases $\hat{\psi}$ and frequencies $\hat{\omega}$ usable in a conventional manner to synthesize the sinusoidal component of the encoded signal.

At the same time, as the sinusoidal components of the signal are being synthesized, the noise code $C_N$ is fed to a noise synthesizer NS 33, which is mainly a filter, having a frequency response approximating the spectrum of the noise. The NS 33 generates reconstructed noise $y_N$ by filtering a white noise signal with the noise code $C_N$. The total signal y(t) comprises the sum of the transient signal $y_T$ and the product of any amplitude decompression (g) and the sum of the sinusoidal signal $y_S$ and the noise signal $y_N$. The audio player comprises two adders 36 and 37 to sum respective signals. The total signal is furnished to an output unit 35, which is e.g. a speaker.

Figure 6:
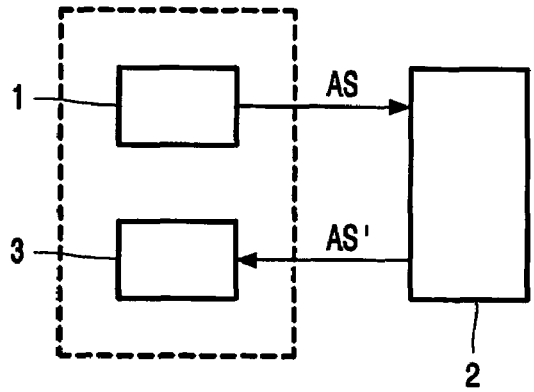
FIG. 6 shows a system comprising an audio coder and an audio player according to the invention.

FIG. 6 shows an audio system according to the invention comprising an audio coder 1 as shown in FIG. 1 and an audio player 3 as shown in FIG. 4. Such a system offers playing and recording features. The audio stream AS is furnished from the audio coder to the audio player over a communication channel 2, which may be a wireless connection, a data 20 bus or a storage medium. In case the communication channel 2 is a storage medium, the storage medium may be fixed in the system or may also be a removable disc, memory stick etc. The communication channel 2 may be part of the audio system, but will however often be outside the audio system.

The invention claimed is:

1. A method of encoding an audio signal by an encoder device for providing the encoded audio signal to a decoder device, the method comprising the acts of:

providing a respective set of sampled signal values for each of a plurality of sequential segments;

analyzing the sampled signal values to determine one or more sinusoidal components for each of the plurality of sequential segments;

linking sinusoidal components across a plurality of sequential segments to provide sinusoidal tracks;

for each sinusoidal track, determining a phase by a phase unwrapper that exposes inter-frame phase behavior for a track, the phase comprising a substantially monotonically changing value;

generating an encoded audio stream by a phase encoder device including sinusoidal codes representing said phase; and interrupting a track by signaling an end of the track, and starting a new track if a phase which will become available in the decoder device differs substantially from the phase present in the encoder device.

2. The method as claimed in claim 1, wherein the phase of each linked segment is determined as a function of: an integral of a frequency for a previous segment and a frequency of said linked segment; and a phase of the previous segment.

3. The method as claimed in claim 1, wherein said sinusoidal components include a phase value in the range $\{\pi,\pi\}$.

4. The method as claimed in claim 1, wherein generating act comprises:

predicting a value of the phase for a segment as a function of a phase for at least a previous segment; and quantizing said sinusoidal codes as a function of said predicted value for said phase and a measured phase for said segment.

5. The method as claimed in claim 4, wherein said sinusoidal codes for a track include an initial phase and an initial frequency, and wherein said predicting act employs said initial frequency and said initial phase to provide a first prediction.

6. The method as claimed in claim 4, wherein said generating act comprises:

controlling said quantizing act as a function of said quantized sinusoidal codes.

7. The method as claimed in claim 6, wherein said sinusoidal codes for each track include an initial quantization stepsize.

8. The method as claimed in claim 1, wherein said sinusoidal codes include an indicator of the end of a track.

9. The method as claimed in claim 1 further comprising:

synthesizing said sinusoidal components using said sinusoidal codes;

subtracting said synthesized signal values from said sampled signal values to provide a set of values representing a remainder component of said audio signal;

modelling the remainder component of the audio signal by determining parameters, approximating the remainder component; and including said parameters in said audio stream.

10. The method as claimed in claim 1, wherein said sampled signal values represent an audio signal from which transient components have been removed.

11. The method of claim 1, wherein the end of the track is signaled by a unique symbol in a bit stream of the phase.

12. A method of decoding an audio stream by a decoder device, the method comprising the acts of:

reading an encoded audio stream encoded by an encoder device and including sinusoidal codes representing a phase for each track of linked sinusoidal components, for each track, generating substantially monotonically changing value from said codes representing said phase;

differentiating and low-pass filtering said generated substantially monotonically changing value to provide an estimate of frequency for a track; and employing said generated substantially monotonically changing value and said frequency estimate to synthesize said sinusoidal components of said audio signal;

interrupting a track by signaling an end of the track, and starting a new track if a phase which will become available in the decoder device differs substantially from the phase present in the encoder device.

13. An audio coder arranged to process a respective set of sampled signal values for each of a plurality of sequential segments of an audio signal, said coder comprising:

an analyzer for analyzing the sampled signal values to determine one or more sinusoidal components for each of the plurality of sequential segments;

a linker for linking sinusoidal components across a plurality of sequential segments to provide sinusoidal tracks;

a phase unwrapper for determining, for each sinusoidal track, a phase comprising a substantially monotonically changing value by exposing inter-frame phase behavior for a track; and a phase encoder for providing an encoded audio stream including sinusoidal codes representing said phase;

wherein a track is interrupted by signaling an end of the track, and a new track is started if a phase which will become available in a decoder differs substantially from the phase present in the coder.

14. An audio player comprising:

means for reading an encoded audio stream received from an audio coder and including sinusoidal codes representing a phase for each track of linked sinusoidal components, said encoded audio stream not including a frequency for the each track;

a phase decoder for determining, for each track, a substantially monotonically changing value from said codes representing said phase;

a filter that approximates differentiation of said generated substantially monotonically changing value to provide an estimate of frequency for a track; and a synthesizer arranged to employ said generated substantially monotonically changing value and said estimate of the frequency to synthesize said sinusoidal components of said audio signal;

wherein a track is interrupted by signaling an end of the track, and a new track is started if a phase which will become available in the audio player differs substantially from the phase present in the audio coder.

15. The audio player of claim 14, wherein the phase decoder includes a quantizer that quantizes the sinusoidal codes to outputs a quantized value for input to a predictive filter for forming the substantially monotonically changing value representing said phase.

16. An audio system comprising an audio coder arranged to process a respective set of sampled signal values for each of a plurality of sequential segments of an audio signal, said audio coder comprising:

an analyzer for analyzing the sampled signal values to determine one or more sinusoidal components for each of the plurality of sequential segments;

a linker for linking sinusoidal components across a plurality of sequential segments to provide sinusoidal tracks;

a phase unwrapper for determining, for each sinusoidal track, a phase comprising a substantially monotonically changing value by exposing inter-frame phase behavior for a track; and a phase encoder for providing an encoded audio stream including sinusoidal codes representing said phase; and an audio player comprising:

means for reading an encoded audio stream including sinusoidal codes representing a phase for each track of linked sinusoidal components;

a sinusoidal synthesizer for determining, for each track, the substantially monotonically changing value from said sinusoidal codes representing said phase;

a filter for differentiating and low-pass filtering said generated substantially monotonically changing value to provide an estimate of frequency for a track; and a synthesizer arranged to employ said generated substantially monotonically changing value and said estimate of the frequency to synthesize said sinusoidal components of said audio signal;

wherein a track is interrupted by signaling an end of the track, and a new track is started if a phase which will become available in the audio player differs substantially from the phase present in the audio coder.

* * * * *